US008378902B2

(12) United States Patent
Lee

(10) Patent No.: US 8,378,902 B2
(45) Date of Patent: Feb. 19, 2013

(54) ANTENNA OF PORTABLE ELECTRONIC DEVICES

(75) Inventor: Yi-Chieh Lee, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 499 days.

(21) Appl. No.: 12/696,156

(22) Filed: Jan. 29, 2010

(65) Prior Publication Data

US 2011/0001675 A1 Jan. 6, 2011

(30) Foreign Application Priority Data

Jul. 1, 2009 (CN) ..... 2009 1 0303906

(51) Int. Cl.
*H01Q 1/24* (2006.01)

(52) U.S. Cl. ..... 343/702; 343/700 MS; 343/729

(58) Field of Classification Search ..... 343/700 MS, 343/702, 725, 729
See application file for complete search history.

(56) References Cited

U.S. PATENT DOCUMENTS

| | | | | |
|---|---|---|---|---|
| 6,204,819 | B1 * | 3/2001 | Hayes et al. | 343/702 |
| 7,839,341 | B2 * | 11/2010 | Seo | 343/702 |
| 2003/0189719 | A1 * | 10/2003 | Saito et al. | 358/1.14 |
| 2005/0190108 | A1 * | 9/2005 | Lin et al. | 343/702 |
| 2007/0008222 | A1 * | 1/2007 | Wang et al. | 343/700 MS |
| 2008/0007467 | A1 * | 1/2008 | Seo | 343/702 |
| 2009/0009401 | A1 * | 1/2009 | Suzuki et al. | 343/700 MS |
| 2010/0065647 | A1 * | 3/2010 | Ritamaki et al. | 235/492 |
| 2010/0277376 | A1 * | 11/2010 | Chakam et al. | 343/702 |
| 2010/0315297 | A1 * | 12/2010 | Wu et al. | 343/702 |

* cited by examiner

*Primary Examiner* — Hoanganh Le
(74) *Attorney, Agent, or Firm* — Altis Law Group, Inc.

(57) ABSTRACT

An antenna used in portable electronic devices includes a first antenna unit shaped as a planar inverted-F antenna (PIFA) and a second antenna unit shaped as a loop antenna and connected to the first antenna unit. The first antenna unit receives/sends wireless signals at relatively higher frequencies, the second antenna unit receives/sends wireless signals at relatively lower frequencies, and the first antenna unit is coupled with the second antenna unit to regulate the working frequency band of the antenna.

12 Claims, 3 Drawing Sheets

ANTENNA OF PORTABLE ELECTRONIC DEVICES

BACKGROUND

1. Technical Field

The present disclosure relates to antennas, and particularly to an antenna used in portable electronic devices.

2. Description of Related Art

Generally, antennas used in the portable electronic devices are very small due to the small size of the portable electronic devices. When working conditions of the portable electronic devices (e.g., ambient temperatures, humidity, and taken/placed manners) changes, working characteristics of these antennas are easily influenced because of their sizes. Thus, frequency offset of the antennas may occur, i.e., the frequencies of wireless signals that can be transferred by the antennas may change. As a result, communication quality of the portable electronic devices may be adversely affected.

Therefore, there is room for improvement within the art.

BRIEF DESCRIPTION OF THE DRAWINGS

Many aspects of the present antenna can be better understood with reference to the following drawings. The components in the various drawings are not necessarily drawn to scale, the emphasis instead being placed upon clearly illustrating the principles of the present antenna. Moreover, in the drawings, like reference numerals designate corresponding parts throughout the figures.

DETAILED DESCRIPTION

Figure 1:
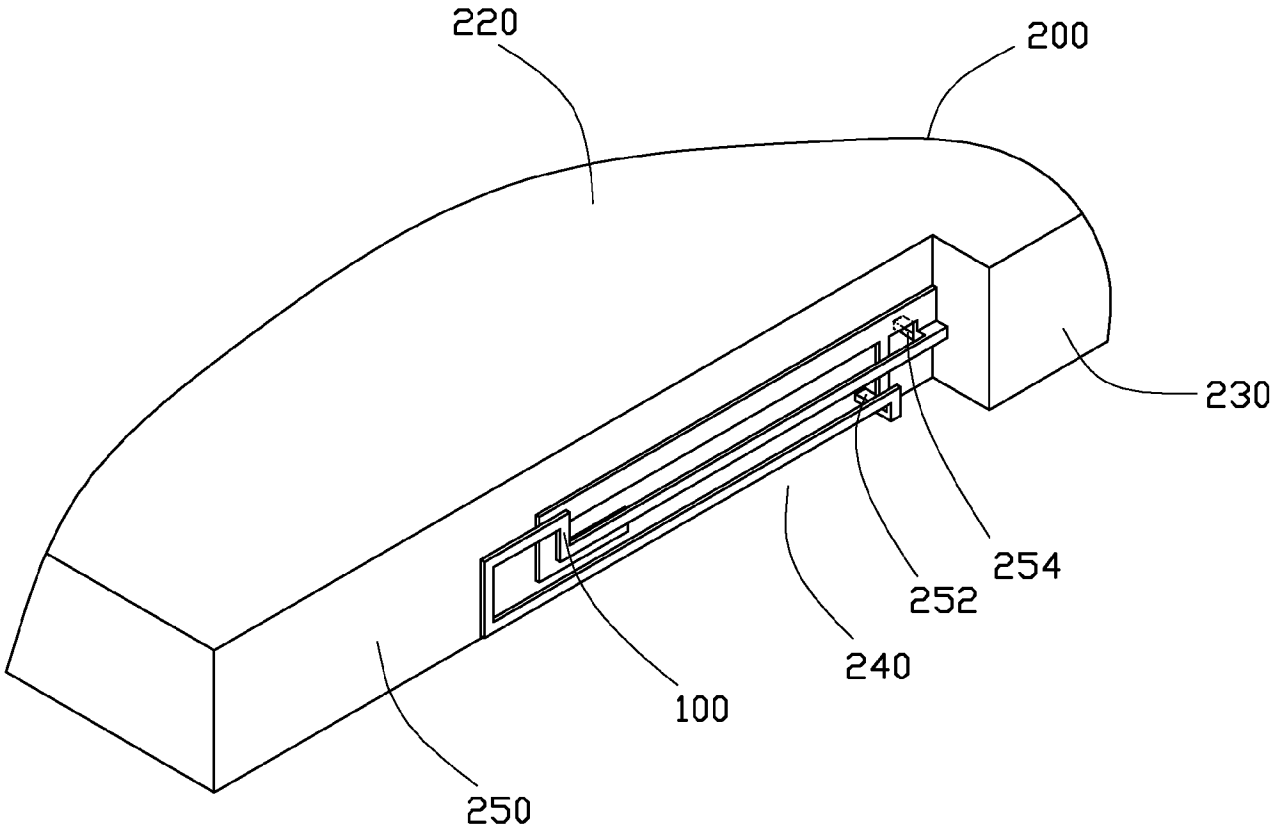
FIG. 1 is a schematic view of an antenna, according to an exemplary embodiment, connected to a circuit board of a portable electronic device.
Figure 2:
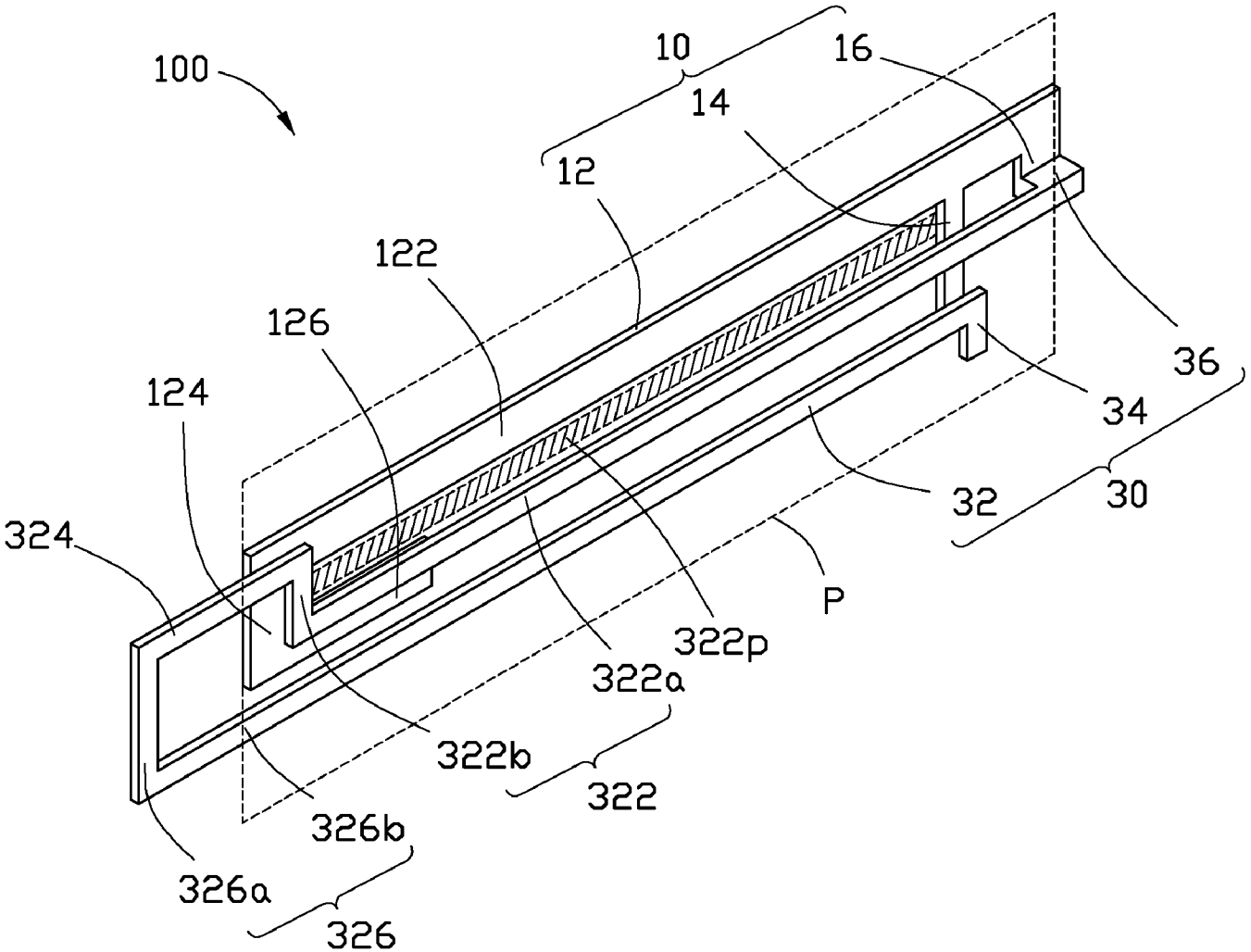
FIG. 2 is an enlarged view of the antenna shown in FIG. 1.

FIG. 1 and FIG. 2 schematically show an antenna 100 according to an exemplary embodiment, for use in portable electronic devices. The antenna 100 can be installed in a portable electronic device and connected to a conventional circuit board 200 of the portable electronic device to receive/send wireless signals when the portable electronic device is used in wireless communications.

The circuit board 200 includes a flat main surface 220 and a flat side surface 230 perpendicularly connected to the main surface 220. One end of the side surface 230 includes a recess, which forms a receiving portion 240. The receiving portion 240 includes a flat assembly surface 250 parallel to the side surface 240. A grounding connector 252 and a feed connector 254 are mounted on the assembly surface 250 and electrically connected to the circuit board 200.

The antenna 100 is made of conductive materials and includes a first antenna unit 10 and a second antenna unit 30.

The first antenna unit 10 is a planar inverted-F antenna (PIFA), which includes a first radio member 12, a first grounding member 14, and a first feed member 16. The first radio member 12, the first grounding member 14, and the first feed member 16 are all flat sheets and are positioned to be coplanar with each other. The first radio member 12 includes a first radio portion 122, a second radio portion 124, and a third radio portion 126, which are all longitudinal flat sheets. An end of the second radio portion 124 is perpendicularly connected to an end of the first radio portion 122. The third radio portion 126 is perpendicularly connected to another end of the second radio portion 124 and is parallel to the first radio portion 122.

The first grounding member 14 is a longitudinal flat sheet. The first feed member 16 is a rectangular flat sheet. The second radio portion 124, the third radio portion 126, the first grounding member 14, and the first feed member 16 are all positioned at a same side of the first radio portion 122. The first feed member 16 is perpendicularly connected to another end of the first radio portion 122 and is parallel to the second radio portion 124. The first grounding member 14 is perpendicularly connected to the first radio portion 122, positioned between the second radio portion 124 and the first feed member 16 and adjacent to the first feed member 16, and is parallel to the second radio portion 124 and the first feed member 16.

The second antenna unit 30 is a loop antenna, which includes a second radio member 32, a second grounding member 34, and a second feed member 36. The second radio member 32 is a flat sheet positioned parallel to the plane in which the first antenna unit 10 is positioned. The second radio member 32 includes a fourth radio portion 322, a fifth radio portion 324, and a sixth radio portion 326.

The fourth radio portion 322 is an L-shaped flat sheet including a first section 322*a* and a second section 322*b*. The first section 322*a* and the second section 322*b* are both longitudinal flat sheets. A projection 332*p* of the first section 322*a*, which is formed on a plane P in which the first antenna unit 10 is positioned, is positioned between the first radio portion 122 and the third radio portion 126, and is parallel to the first radio portion 122 and the third radio portion 126, as shown in FIG. 2. An end of the second section 322*b* is perpendicularly connected to an end of the first section 322*a*. Another end of the first section 322*a* is aligned with an end of the first feed member 16.

The fifth radio portion 324 is a longitudinal flat sheet. An end of the fifth radio portion 324 is perpendicularly connected to another end of the second section 322*b*, and the fifth radio portion 324 and the first section 322*a* are respectively positioned at two sides of the second section 322*b*. The first section 322*a* and the fifth radio portion 324 are positioned parallel to each other and extend away from the second section 322*b* along two opposite directions, correspondingly.

The sixth radio portion 326 is an L-shaped flat sheet positioned coplanar with the fourth radio portion 322 and includes a third section 326*a* and a fourth section 326*b*. The third section 326*a* and the fourth section 326*b* are both longitudinal flat sheets. An end of the third section 326*a* is perpendicularly connected to another end of the fifth radio portion 324, and the third section 326*a* is parallel to the second section 322*b*. An end of the fourth section 326*b* is perpendicularly connected to another end of the third section 326*a*. The fourth section 326*b*, the fifth radio portion 324, and the fourth radio portion 322 are positioned at a same side of the third section 326*a*. The fourth section 326*b* is parallel to the fifth radio portion 324 and the first section 322*a*.

The second grounding member 34 is a rectangular flat sheet coplanar with the second radio member 32. The second grounding member 34 is perpendicularly connected to another end of the fourth section 326*b*, and the third section 326*a* and the second grounding member 34 are respectively positioned at two sides of the fourth section 326*b*. An end of the second grounding member 34 is aligned with an end of the first grounding member 14. The second feed member 36 is a connecting section. Two ends of the second feed member 36 are respectively perpendicularly connected to the end of the first section 322*a* and the end of the first feed member 16 that are aligned with each other, such that the first antenna unit 10 and the second antenna unit 30 are connected together.

In assembly, conventional electronic components (not shown) of the portable electronic device can be mounted on the main surface 220. The antenna 100 is received in the receiving portion 240. The grounding connector 252 is connected to the first grounding member 34, and is further connected to the second grounding member 36 via the first grounding member 34. The feed connector 254 is connected to both the end of the first grounding member 14 and the end of the second grounding member 34 that are aligned with each other. Thus, the antenna 100 is mounted on a side edge of the circuit board 200 and does not occupy much space.

In use, the circuit board 200 provides feed signals to the first feed member 16 via the feed connector 254, and the feed signals are transmitted to the second feed member 36 via the first feed member 16. Both the first antenna unit 10 and the second antenna unit 30 can be grounded by the grounding connector 252. Thus, the first antenna unit 10 and the second antenna unit 30 operate as antennas. Particularly, the first antenna unit 10 can receive/send wireless signals at relatively higher frequencies (e.g., about 2.6 GHz), and the second antenna unit 30 can receive/send wireless signals at relatively lower frequencies (e.g., about 2.38 GHz). Furthermore, the first antenna unit 10 and the second antenna unit 30 can be coupled with each other. The coupling between the first antenna unit 10 and the second antenna unit 30 can change the impedance of the antenna 100, and further regulate the working frequency band of the antenna 100, such that the multiband antenna 100 can be used to receive/send wireless signals across a wide frequency band.

Figure 3:
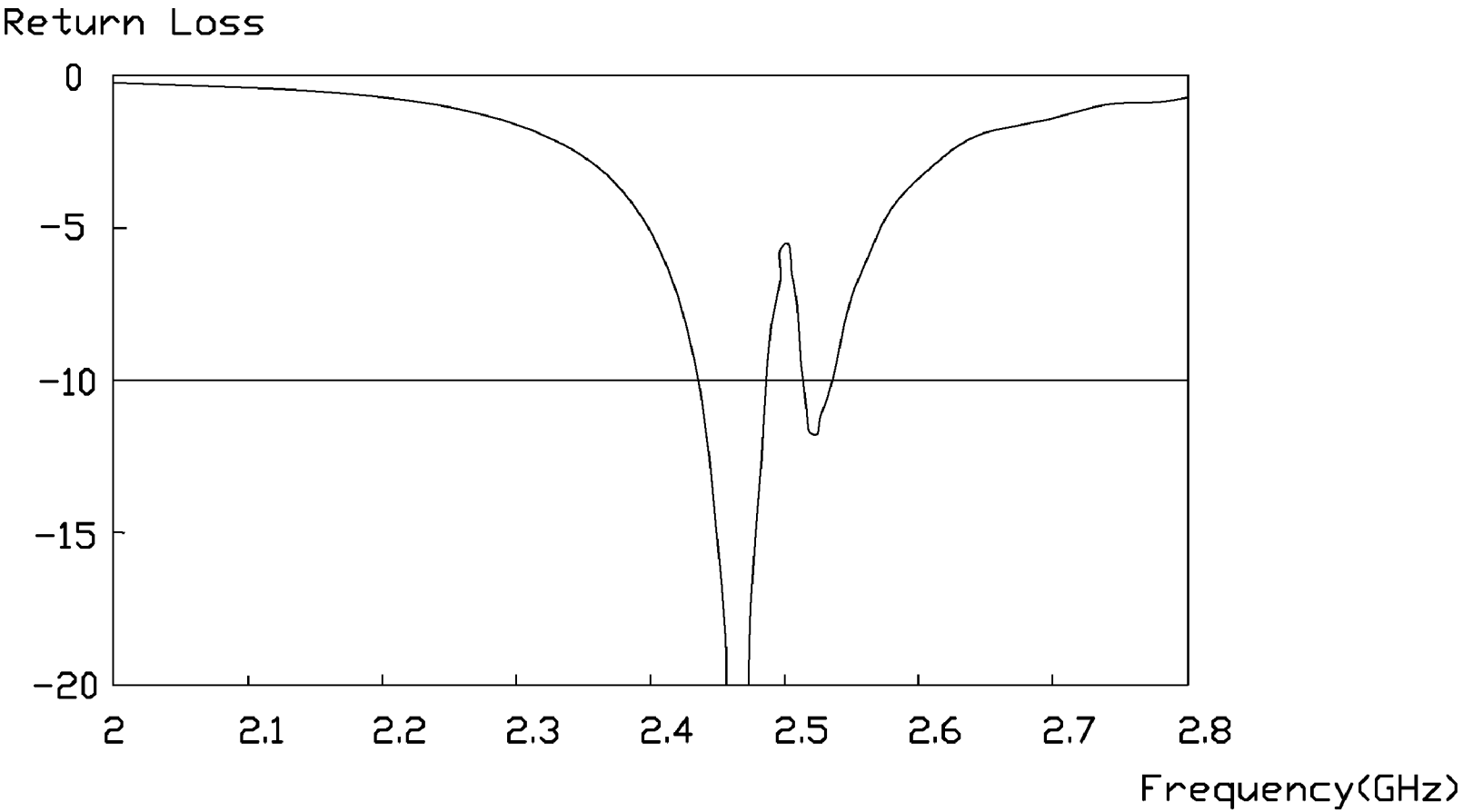
FIG. 3 is a diagram of measuring a return loss (RL) of the antenna shown in FIG. 1.

Referring to FIG. 3, as known in experiments, in a frequency band of about 2.40 GHz-2.485 GHz, the return loss (RL) of the antenna 100 is acceptable. Therefore, the multiband antenna 100 can be used in WLAN communication systems (Wireless Local Area Network, using wireless signals at working frequency of about 2400 MHz). When the working conditions of the portable electronic device (e.g., ambient temperatures, humidity, and taken/placed manners) change, the coupling between the first antenna unit 10 and the second antenna unit 30 can be used to regulate the working frequency band of the antenna 100 and compensate the changes of the working frequency caused by the changed working conditions (i.e., compensate the influence of the frequency offset). According to experiments, when the portable electronic device with the antenna 100 installed therein is manually held, the frequency offset of the antenna 100 is not evident, and the antenna 100 can also normally receive/send wireless signals used in WLAN communication systems. The distance between the first radio member 12 and the second radio member 32 can be regulated to obtain a desirable coupling effect.

In the present disclosure, the outer dimension of the exemplary multiband antenna 100 is about 26.8 mm×4.0 mm×0.8 mm. The distance between the two planes in which the first radio member 12 and the second radio member 32 are respectively positioned is about 0.4 mm. Apparently, the antenna 100 is very small in size, and can be easily mounted on the side edge of the circuit board and received in the housing of the portable electronic device.

The present antenna 100 is small in size and has good communication quality in at a plurality of frequency bands used in wireless communication, which can allow further size reductions of portable electronic devices employing the antenna 100. Note that the dimensions set forth herein are exemplary of the working frequencies also mentioned herein. Accordingly, the dimensions of the antenna 100 are not limited to the dimensions set forth in this specification.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. An antenna used in portable electronic devices, comprising:

a first antenna unit shaped as a planar inverted-F antenna (PIFA); and a second antenna unit shaped as a loop antenna and connected to the first antenna unit;

wherein the first antenna unit serves as a PIFA and receives/sends wireless signals at relatively higher frequencies upon reception of feed signals, the second antenna unit simultaneously serves as a loop antenna and receives/sends wireless signals at relatively lower frequencies upon reception of feed signals, and the first antenna unit can be coupled with the second antenna unit to regulate the working frequency band of the antenna;

and wherein the first antenna unit includes a first radio member, the second antenna unit includes a second radio member, and the first radio member and the second radio member are both flat sheets and parallel to each other, the first radio member includes a first radio portion, a second radio portion, and a third radio portion, which are all longitudinal flat sheets; an end of the second radio portion perpendicularly connected to an end of the first radio portion, the third radio portion perpendicularly connected to another end of the second radio portion and parallel to the first radio portion; the second radio member includes a fourth radio portion, a fifth radio portion, and a sixth radio portion; the fourth radio portion including a longitudinal first section and a longitudinal second section, an end of the second section perpendicularly connected to an end of the first section; the fifth radio portion being a longitudinal flat sheet, an end of the fifth radio portion perpendicularly connected to another end of the second section; the sixth radio portion including a longitudinal third section and a longitudinal fourth section, an end of the third section perpendicularly connected to another end of the fifth radio portion, and the third section parallel to the second section; an end of the fourth section perpendicularly connected to another end of the third section;

and wherein a projection of the first section formed on the plane of the first antenna unit and is positioned between and parallel to the first radio portion and the third radio portion.

2. The antenna as claimed in claim 1, wherein the first antenna unit further includes a first feed member connected to another end of the first radio portion and the second antenna unit further includes a second feed member connected to another end of the first section and also connected to the first feed member, the first feed member and the second feed member configured for respectively receiving feed signals of the first antenna unit and the second antenna unit.

3. The antenna as claimed in claim 2, wherein the first antenna unit further includes a first grounding member connected to the first radio portion and the second antenna unit further includes a second grounding member connected to the fourth section, and an end of the first grounding member aligned with an end of the second grounding member.

4. The antenna as claimed in claim 3, wherein the first grounding member is adjacent to the end of the first radio portion connected to the first feed member, and the second grounding member is connected to a distal end of the fourth section.

5. The antenna as claimed in claim 4, wherein both the first feed member and the first grounding member are flat sheets, and are coplanar with the first radio portion, the second radio portion, and the third radio portion.

6. The antenna as claimed in claim 5, wherein the second grounding member is a flat sheet, and is coplanar with the fourth radio portion, the fifth radio portion, and the sixth radio portion; and the plane where the first radio portion, the second radio portion, the third radio portion, the first feed member, and the first grounding member are positioned is parallel to the plane where the fourth radio portion, the fifth radio portion, the sixth radio portion, and the second grounding member are positioned.

7. An antenna used in portable electronic devices, comprising:

a first antenna unit shaped as a planar inverted-F antenna (PIFA), the first antenna unit including a first radio member and a first feed member connected to the first radio member for receiving feed signals; and a second antenna unit shaped as a loop antenna, the second antenna unit includes a second radio member and a second feed member connected to the second radio member for receiving feed signals; wherein the second feed member is also connected to the first feed member to connect the first antenna unit and the second antenna unit together; and wherein the first antenna unit serves as a PIFA upon reception of feed signals, and the second antenna unit simultaneously serves as a loop antenna upon reception of feed signals;

and wherein the first antenna unit includes a first radio member, the second antenna unit includes a second radio member, and the first radio member and the second radio member are both flat sheets and parallel to each other; the first radio member includes a first radio portion, a second radio portion, and a third radio portion, which are all longitudinal flat sheets; an end of the second radio portion perpendicularly connected to an end of the first radio portion, the third radio portion perpendicularly connected to another end of the second radio portion and parallel to the first radio portion; the second radio member includes a fourth radio portion, a fifth radio portion, and a sixth radio portion; the fourth radio portion including a longitudinal first section and a longitudinal second section, an end of the second section perpendicularly connected to an end of the first section; the fifth radio portion being a longitudinal flat sheet, an end of the fifth radio portion perpendicularly connected to another end of the second section; the sixth radio portion including a longitudinal third section and a longitudinal fourth section, an end of the third section perpendicularly connected to another end of the fifth radio portion, and the third section parallel to the second section; an end of the fourth section perpendicularly connected to another end of the third section;

and wherein a projection of the first section formed on the plane in which the first antenna unit is positioned is positioned between the first radio portion and the third radio portion, and is parallel to the first radio portion and the third radio portion.

8. The antenna as claimed in claim 7, wherein the first feed member is connected to another end of the first radio portion, and the second feed member is connected to another end of the first section.

9. The antenna as claimed in claim 8, wherein the first antenna unit further includes a first grounding member connected to the first radio portion and the second antenna unit further includes a second grounding member connected to the fourth section, and an end of the first grounding member is aligned with an end of the second grounding member.

10. The antenna as claimed in claim 9, wherein the first grounding member is adjacent to the end of the first radio portion connected to the first feed member, and the second grounding member is connected to a distal end of the fourth section.

11. The antenna as claimed in claim 10, wherein both the first feed member and the first grounding member are flat sheets, and are coplanar with the first radio portion, the second radio portion, and the third radio portion.

12. The antenna as claimed in claim 11, wherein the second grounding member is a flat sheet, and is coplanar with the fourth radio portion, the fifth radio portion, and the sixth radio portion; and the plane where the first radio portion, the second radio portion, the third radio portion, the first feed member, and the first grounding member are positioned is parallel to the plane where the fourth radio portion, the fifth radio portion, the sixth radio portion, and the second grounding member are positioned.

* * * * *